US006695513B1

(12) United States Patent
Malek

(10) Patent No.: US 6,695,513 B1
(45) Date of Patent: Feb. 24, 2004

(54) HAIR PRODUCT APPLICATION PACKAGE AND METHOD OF USE

(76) Inventor: Linda M. Malek, 2865 Hickory Cove, Cuyahoga Falls, OH (US) 44223

( * ) Notice: Subject to any disclaimer, the term of this patent is extended or adjusted under 35 U.S.C. 154(b) by 0 days.

(21) Appl. No.: 10/231,692

(22) Filed: Aug. 29, 2002

(51) Int. Cl.[7] ..... A46B 11/00

(52) U.S. Cl. ..... 401/129; 401/6; 401/122; 401/126; 401/127; 401/192; 132/112

(58) Field of Search ..... 401/6, 118, 121, 401/122, 126, 127, 129, 192; 424/70.2; 132/112–116, 203–207, 210

(56) References Cited

U.S. PATENT DOCUMENTS

| | | | | | |
|---|---|---|---|---|---|
| 4,511,513 | A | * | 4/1985 | Guth et al. | 554/59 |
| 4,645,663 | A | * | 2/1987 | Grollier et al. | 424/62 |
| 4,875,792 | A | | 10/1989 | Canada | |
| 4,927,281 | A | * | 5/1990 | Gueret | 401/129 |
| 5,195,545 | A | * | 3/1993 | Thibodeaux | 132/112 |
| 5,655,551 | A | | 8/1997 | Knight | |
| 5,762,432 | A | | 6/1998 | Dunleavy et al. | |
| 5,816,728 | A | | 10/1998 | Nardolillo et al. | |
| 5,845,653 | A | | 12/1998 | Abercrombie | |
| 5,879,669 | A | * | 3/1999 | Clausen et al. | 424/70.11 |
| 5,964,226 | A | | 10/1999 | Sobel | |
| 6,053,179 | A | | 4/2000 | Lhuisset | |
| 6,143,307 | A | * | 11/2000 | Maurin | 424/70.1 |
| 6,210,057 | B1 | * | 4/2001 | Yannaci et al. | 401/6 |
| 6,241,411 | B1 | | 6/2001 | Brieva et al. | |
| D445,953 | S | | 7/2001 | Smith | |
| D449,407 | S | | 10/2001 | Altobellis et al. | |
| 6,306,377 | B1 | * | 10/2001 | Coppola et al. | 424/70.2 |
| D451,638 | S | | 12/2001 | Lablaine | |
| RE37,605 | E | | 3/2002 | Clay | |
| 6,450,720 | B1 | * | 9/2002 | Cai | 401/129 |

FOREIGN PATENT DOCUMENTS

| | | | | |
|---|---|---|---|---|
| DE | 3535351 | A1 | * 4/1987 | A61K/7/09 |

* cited by examiner

*Primary Examiner*—Tuan N. Nguyen
(74) *Attorney, Agent, or Firm*—P. Jeff Martin

(57) ABSTRACT

A hair product application package is provided for applying a supply of hair gel product to curly hair in order to facilitate straightening thereof. A translucent plastic container is included for storing a product applicator and the clear, gelatinous composition. The product applicator has an ergonomically designed cap so as to allow easy user manipulation and control thereof. The product applicator includes bristles defined as split fibers. The product supply is a composition having properties facilitating a greaseless, non-wet appearance when applied to consumer's hair.

19 Claims, 4 Drawing Sheets

HAIR PRODUCT APPLICATION PACKAGE AND METHOD OF USE

RELATED APPLICATIONS

The present invention was first described in Disclosure Document Registration No. 512,090 filed on May 28, 2002 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to hair care products and, more particularly, to a hair product application package and method for using the same.

2. Description of the Related Art

Many individuals undergo the arduous task of grooming or treating their hair for various purposes through the application of assorted cosmetic substances. More specifically, moisture treatments, hair-coloring treatments, conditioning, and hair-straightener treatments are just a few examples.

Regarding hair-straightener treatments, a common annoyance realized by many is the reappearance of curls or what is commonly referred to as "wild hairs" around the hairline shortly after the application of the treatment. Such problem is further magnified for individuals possessing naturally curly hair. To combat the problem, many choose to self-administer various solutions found around the home as a quick-fix remedy. Such attempted remedy typically results in unwanted difficulties such as clumping and uneven distribution of the solution, an unsightly, greasy appearance, and possible damage to the hair.

Accordingly, there is a need for a means by which a clear, gelatinous substance can be easily applied to curly hair in order to facilitate straightening thereof which is gentle on the hair and virtually undetectable by casual observation, in a manner which is quick, easy, and effective. The development of the hair product application package and method for using the same fulfills this need.

A search of the prior art did not disclose any patents that read directly on the claims of the instant invention; however, the following references were considered related.

The following patents disclose applicators and brushes for use in the application of cosmetics and hair care products:

U.S. Pat. No. 6,053,179, issued in the name of Lhuisset, U.S. Pat. No. 5,655,551, issued in the name of Knight; U.S. Pat. No. 5,762,432, issued in the name of Dunleavy et al.; U.S. Pat. No. 5,845,653, issued in the name of Abercrombie; U.S. Pat. No. 4,875,792, issued in the name of Canada; and U.S. Pat. No. 6,241,411 B1, issued in the name of Brieva et al.

The following patents disclose mascara applicators:

U.S. Pat. No. RE 37,605 E, issued in the name of Clay; and U.S. Pat. No. 5,816,728, issued in the name of Nardolillo et al.

U.S. Pat. No. 6,220,254 B1, issued in the name of Gueret, discloses a device for packaging and applying a substance that is a liquid, a semiliquid, or a powder, particularly a cosmetic product.

U.S. Pat. No. 5,964,226, issued in the name of Sobel, discloses an apparatus and method for applying a hair product to hair.

U.S. Des. Pat. No. 445,953 S, issued in the name of Smith, discloses the ornamental design for a hair care bottle with applicator.

U.S. Des. Pat. No. 449,407 S, issued in the name of Altobellis et al., discloses the ornamental design for an applicator for applying a viscous fluid.

And, U.S. Des. Pat. No. 451,638 S, issued in the name of Lablaine, discloses the ornamental design for a cosmetics applicator.

Consequently, a need has been felt for a means by which a clear, gelatinous substance can be easily applied to curly hair in order to facilitate straightening thereof which is gentle on the hair and virtually undetectable by casual observation, in a manner which is quick, easy, and effective.

SUMMARY OF THE INVENTION

Therefore, it is an object of the present invention to provide a hair product application package which includes a sealable, translucent container for storing a product applicator and product supply.

It is another object of the present invention to provide a cap having an ergonomic design thereby allowing user to easily manipulate and control the applicator during use.

It is still another object of the present invention to provide an applicator having bristles defined as split fibers.

It is still another object of the present invention to provide a hollow wiper serving to remove excess product supply from bristles.

It is another object of the present invention to provide a product supply of a clear, gelatinous or jelly-like substance having properties facilitating a greaseless, non-wet appearance when applied to consumer's hair.

It is another object of the present invention to provide a product supply serving to smooth or straighten hair for a duration of approximately 6 hours per application.

It is another object of the present invention to provide product supply designed and configured so as to be applied to curly hair, particularly individuals possessing naturally curly hair, in order to facilitate straightening thereof.

It is another object of the present invention to provide a product supply having a composition being hypoallergenic and non-flaking.

It is another object of the present invention to provide a product supply having a composition which prevents occlusivity.

It is another object of the present invention to provide a hair product being easy to apply.

It is another object of the present invention to provide a method of use for the hair product application package.

Briefly described according to one embodiment of the present invention, a hair product application package and method of use is provided for applying a supply of hair gel product to curly hair in order to facilitate straightening thereof. A translucent plastic container is included for storing the clear, gelatinous composition.

A product applicator is provided for facilitating application of the gelatinous composition: The product applicator has an ergonomically designed cap defined as having a plurality of finger-gripping channels allowing user to easily manipulate and control the product applicator during use. The container is designed and configured to threadedly receive the cap in such a manner so as to produce an air-tight sealable connection therebetween, thus preventing drying, leakage, spillage, or evaporation of stored product supply. The cap is further defined as having a semi-flexible, plastic rod extending longitudinally therefrom.

An axle is fixedly secured to the rod via epoxy. The axle is comprised of bristles which are securably embedded circumferentially along a length thereof. The bristles are defined as split fibers fabricated from a combination of natural and synthetic materials.

A hollow wiper, integrally molded below a threaded neck of container, serves to remove excess product supply or gelatinous composition from bristles of product applicator.

The product supply is defined as a clear, gelatinous or jelly-like composition having properties facilitating a greaseless, non-wet appearance when applied to consumer's hair. The product supply is further designed and configured to be applied more particularly to areas defining user's hairline. The product supply is comprised of the following ingredients: glycerol monooleate (GMO); sodium stearate; glycerin; purified $H_2O$; antibacterial agent; triundecanoin; isocetyl alcohol; and preservatives.

The use of the present invention allows a user to apply a gelatinous hair product to curly hair in order to facilitate straightening thereof which is virtually undetectable by casual observation, in a manner which is quick, easy, and efficient.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

A. DETAILED DESCRIPTION OF THE FIGURES

Figure 1:
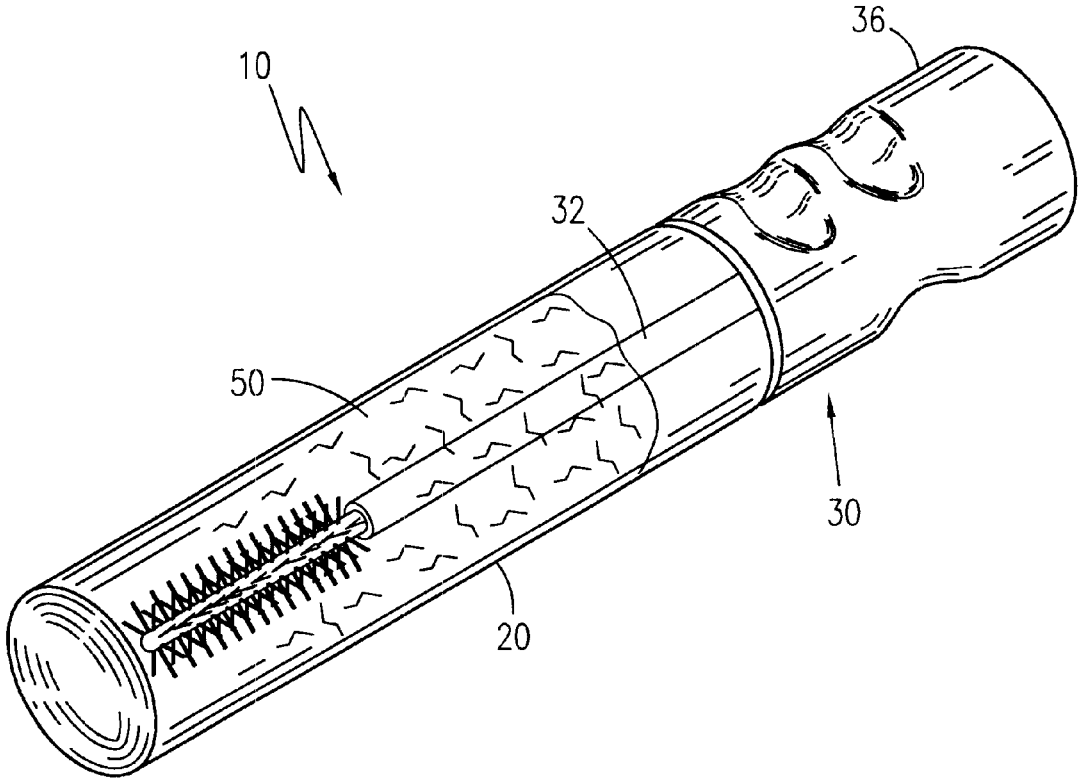
FIG. 1 is a perspective view of a hair product application package according to the preferred embodiment of the present invention.

Referring now to FIGS. 1–4, a hair product application package 10 is shown, according to the present invention, comprised of a container 20 for storing product applicator 30 and product supply 50. The container 20 is of an elongated, circular configuration and is fabricated of a material being suitable for storing the product supply 50. It is envisioned that the container 20 is fabricated of a translucent plastic material. It is recognized that glass may alternatively be utilized and be equally functional, however, in view of the significant weight differential between plastic and glass, plastic is the preferred fabrication material. The container 20 terminates in a threaded neck 22 having an opening 24 adapted to receive rod 32 of product applicator 30. The threaded neck 22 threadedly receives corresponding interior threads 34 formed on an inside of cap 36 (to be described in greater detail below) of product applicator 30. Tightening of cap 36 produces an air-tight sealable connection with the container 20 thereby preventing drying, leakage, spillage, or evaporation of stored product supply 50 within container 20.

Figure 2:
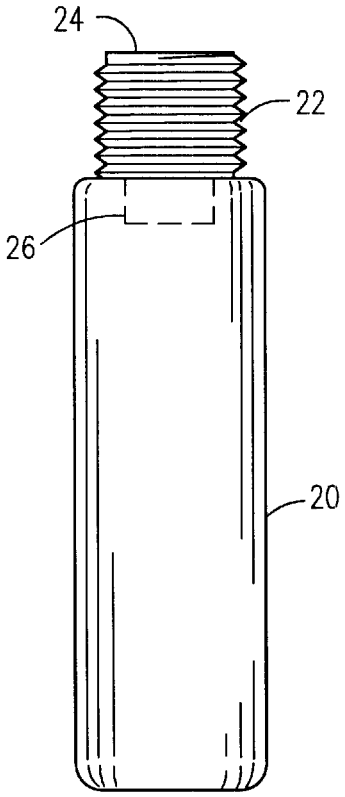
FIG. 2 is a side elevational view of the container according to the preferred embodiment of the present invention.
Figure 3A:
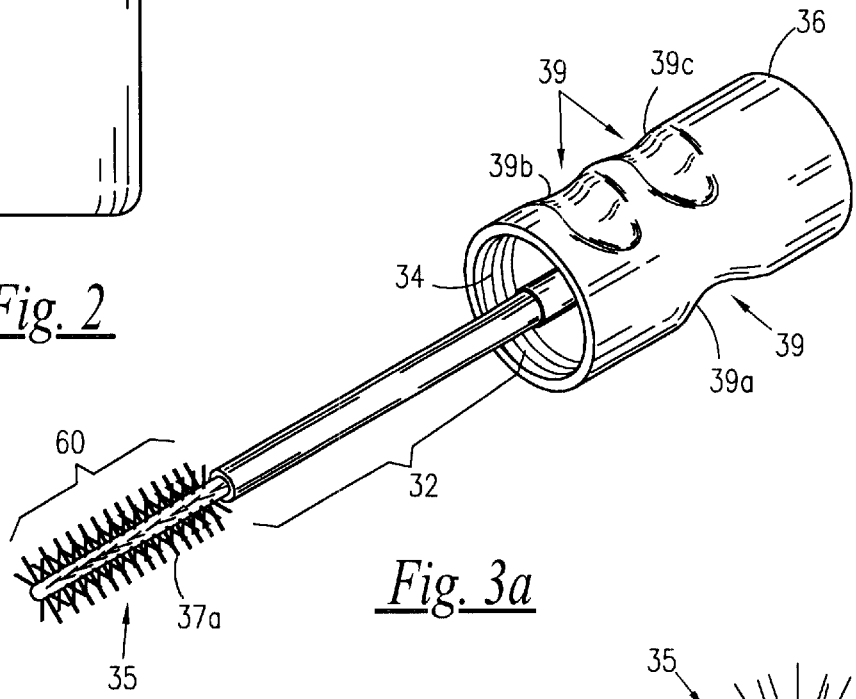
FIG. 3*a* is a side elevational view of the product applicator according to the preferred embodiment of the present invention.
Figure 3B:
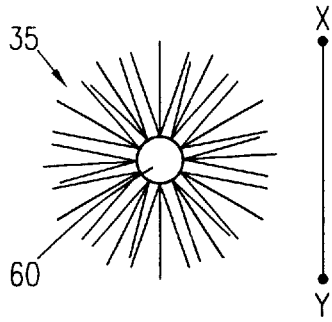
FIG. 3*b* is a front end view of the bristles shown embedded within the axle.
Figure 4:
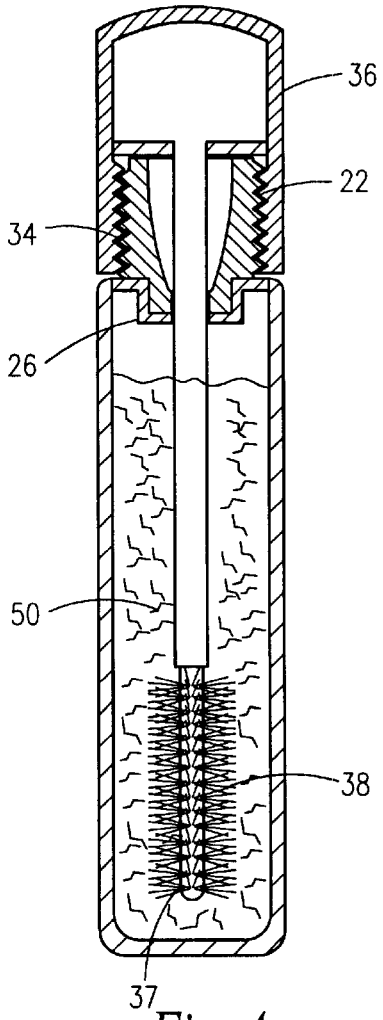
FIG. 4 is a cross-sectional view of the product applicator, container, and product supply according to the preferred embodiment of the present invention.
Figure 5:
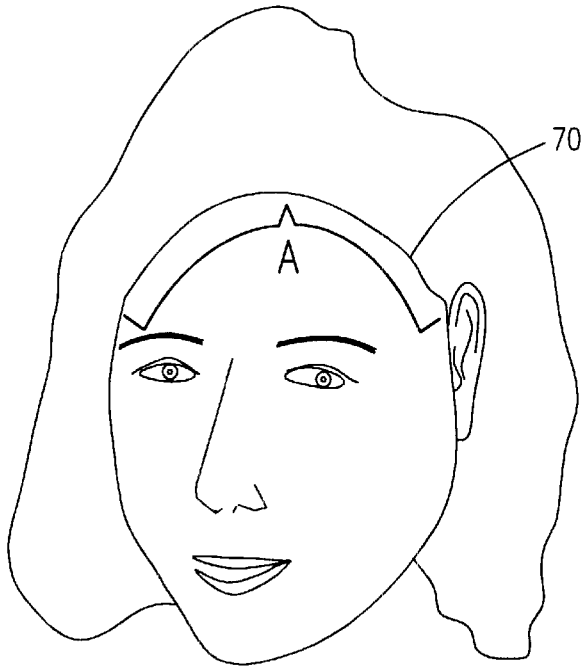
FIG. 5 is a perspective view of user's hairline area for application of the product supply according to the preferred embodiment of the present invention.
Figure 6A:
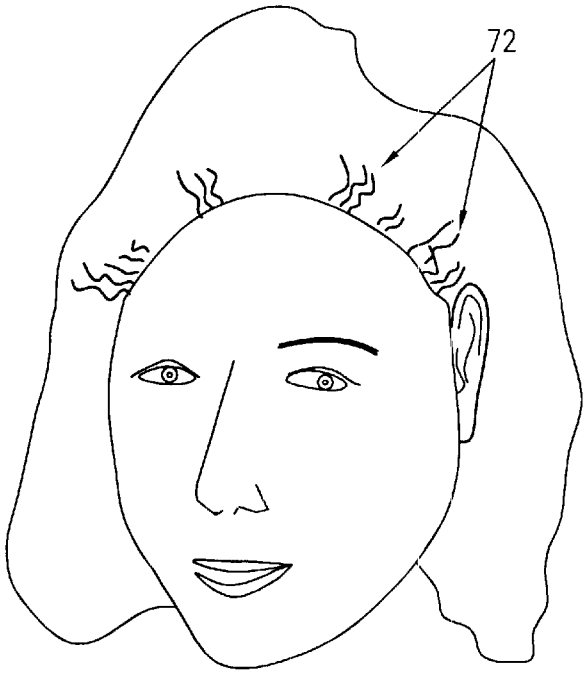
FIG. 6*a* is a perspective view of user before application of the present invention.
Figure 6B:
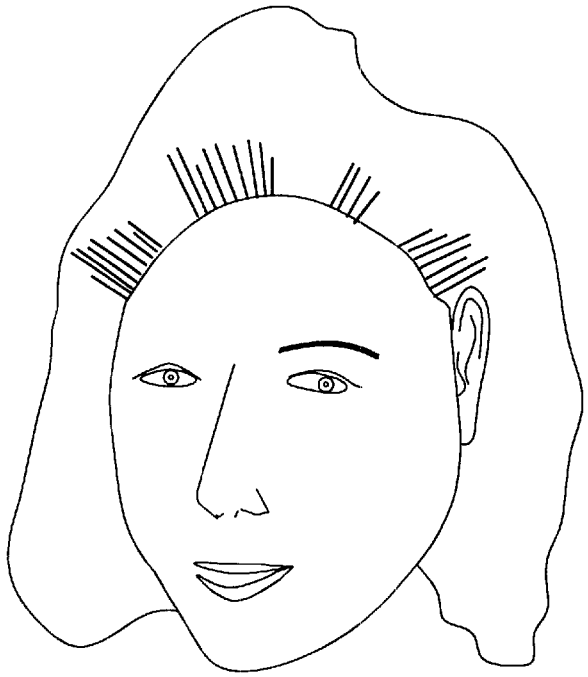
FIG. 6*b* is a perspective view of user after application of the present invention.

Referring more specifically to FIGS. 2 and 4, a hollow, tubular wiper 26, integrally molded below threaded neck 22 of container 20, serves to remove excess product supply 50 from bristles 35 of product applicator 30, thus not only preventing over application of product supply 50, but also preventing needless waste thereof. The hollow wiper 26 is designed as having a diameter measuring substantially equal to a diameter of the bristles 35 when looking at a front end view thereof, wherein bristles 35 diameter for this particular purpose is defined as a diameter of bristles 35 as embedded circumferentially along a length of an axle 60, as depicted by line XY shown in FIG. 3*b*.

Referring now to FIGS. 1, 3*a*, 3*b*, 4, and 5, the cap 36 is defined as having an ergonomic design with a plurality of finger-gripping channels 39, thereby allowing user to easily manipulate and control the product applicator 30 during use. More specifically, a thumb receiving channel 39*a* is formed along an external circumferential surface of the cap 36, and lies opposite both an index finger receiving channel 39*b* and a middle finger receiving channel 39*c*, which are also formed along an external circumferential surface of the cap 36. The index finger receiving channel 39*b* is positioned adjacent to the middle finger receiving channel 39*c*.

The cap 36 is further defined as being fabricated of a plastic material and has a semi-flexible, plastic rod 32 extending longitudinally therefrom.

An axle 60, fabricated of a plastic material, is fixedly secured to the rod 32 via epoxy, and wherein axle 60 extends longitudinally from rod 32. The axle 60 is further defined as having a length measuring between approximately 15 mm (millimeters) to 25 mm.

Bristles 35 are securably embedded circumferentially along a length of the axle 60 and extend radially therefrom. Because the cap 36 makes an air-tight sealable connection with the container 20, the bristles 35 are prevented from drying out. The bristles 35 are defined as split fibers 37 fabricated from a combination of natural and synthetic materials. The split fibers 37 are made predominantly of boar's hair 38. Synthetic materials include but are not limited to polytetrafluoroethylene, nylon, and polyester. For purposes of this disclosure, split fibers 37 are formed from fibers each having stress weld points, wherein each fiber will split at a stress point thereof after having mechanical pressure exerted thereagainst.

It is envisioned that axle 60 has a fiber density of approximately 75 split fibers 37 per 7 mm axle 60 length. It is further envisioned that each individual fiber 37*a* of each split fiber 37 has a length measuring approximately 2 mm to 4 mm.

The bristles 35 facilitate optimal application of product supply 50. Intrinsically, dimensional characteristics attributable to fiber length and fiber fabrication materials described hereinabove are critical for facilitating optimal and even distribution of product supply so as to not only allow for ease in application thereof, but also to facilitate undetectable application of product supply 50.

Referring now to FIGS. 1–6*b*, the product supply 50 is defined as a clear, gelatinous or jelly-like composition having properties facilitating a greaseless, non-wet appearance when applied to consumer's hair. Thus, upon application, product supply 50 is virtually undetectable by casual observation.

The product supply 50 is designed and configured so as to be applied to curly hair 72, particularly individuals possessing naturally curly hair 72, in order to facilitate straightening thereof. The product supply 50 is further designed and configured to be applied notably in areas of user's hairline 70 depicted in FIG. 5 and designated by the area "A".

B. COMPOSITION

The product supply 50, according to the preferred embodiment of present invention, is comprised of the following ingredients: glycerol monooleate (GMO); sodium stearate; glycerin; purified $H_2O$; antibacterial agents; triundecanoin; isocetyl alcohol; and preservatives.

The product supply 50, according to a first alternate embodiment of present invention, is comprised of the following ingredients: glycerol monooleate (GMO); propylene glycol (PEG); sodium stearate; glycerin; purified $H_2O$; antibacterial agents; triundecanoin; isocetyl alcohol; fragrance; and preservatives.

The product supply 50, according to a second alternate embodiment of present invention, is comprised of the following ingredients: glycerol monooleate (GMO); propylene glycol (PEG); sodium stearate; glycerin; purified $H_2O$; antibacterial agents; triundecanoin; isocetyl alcohol; and preservatives.

GMO and PEG provide water-soluble, colorless bases.

Several of the aforementioned ingredients may have one or more sub-components. For example, the antibacterial agents include but are not limited to a mixture of senegal extract, witch hazel, and chickweed extract. The antibacterial agents serve to protect against free radicals.

Preservatives serve to prevent oxidation, mold growth or spoilage of the product supply 50. These include potassium sorbate and sodium benzoate.

Other ingredients serve various other purposes. For example, triundecanoin functions to control occlusivity or clumping. Isocetyl alcohol provides a low viscosity emollient.

The product supply 50, according to the preferred embodiment of present invention, provides a formulation designed and configured so as to smooth or straighten hair for a duration of approximately 6 hours per application.

Additional advantages of the present invention include a composition being hypoallergenic and non-flaking.

C. EXAMPLES

The following examples represent various combinations of ingredients of the present invention so as to further illustrate the product supply 50 thereof.

Example 1

This example sets forth the general formulation of the preferred embodiment for the product supply 50 of the present invention.

| INGREDIENTS | COMPOSITION BY WEIGHT |
|---|---|
| Glycerol Monooleate (GMO) | 80–90% |
| Sodium Stearate | 0.1–9% |
| Glycerin | 0.1–5% |
| Purified $H_2O$ | 1–5% |
| Antibacterial Agents | 0.05–2% |
| Triundecanoin | 0.75–5% |
| Isocetyl Alcohol | 0.65–0.75% |
| Preservatives | 0.1% |

Example 2

This example shows a first alternative formulation for the product supply 50 of the present invention.

| INGREDIENTS | COMPOSITION BY WEIGHT |
|---|---|
| Glycerol Monooleate (GMO) | 75–89% |
| Propylene Glycol (PEG) | 0.75–5% |
| Sodium Stearate | 0.1–9% |
| Glycerin | 0.1–5% |
| Purified $H_2O$ | 1–5% |
| Antibacterial Agents | 0.05–2% |
| Triundecanoin | 0.75–5% |
| Isocetyl Alcohol | 0.65–0.75% |
| Fragrance | 0.9–2% |
| Preservatives | 0.1% |

Example 3

This example shows a second alternative formulation for the product supply 50 of the present invention.

| INGREDIENTS | COMPOSITION BY WEIGHT |
|---|---|
| Glycerol Monooleate (GMO) | 75–89% |
| Propylene Glycol (PEG) | 0.75–5% |
| Sodium Stearate | 0.1–9% |
| Glycerin | 0.1–5% |
| Purified $H_2O$ | 1–5% |
| Antibacterial Agents | 0.05–2% |
| Triundecanoin | 0.75–5% |
| Isocetyl Alcohol | 0.65–0.75% |
| Preservatives | 0.1% |

D. METHOD of USE

The specific method of use of the present invention includes unscrewing cap 36 from the container 20, and slowly removing the applicator 30 therefrom, past the hollow wiper 26, thereby removing excessive accumulation of product supply 50. The bristles 35 of the product applicator 30 are aligned parallel with respect to curly hair 72 located along user's hairline 70. The bristles 35 of the product applicator 30 are directed against the hairline 70 wherein the split fibers 37 of the bristles 35 are easily threaded through curly hair 72. The scalp is then combed through in a direction away from hairline 70, thereby applying an even, optimal distribution of product supply 50 to required areas being virtually undetectable by casual observation. Manipulation and control of the product applicator 30 is facilitated via the finger-gripping channels 39. Finally, the product applicator 30 is reinserted within the container 20 and the cap 36 is tightened, thereby preventing drying, leakage, spillage, or evaporation of stored product supply 50.

2. Operation of the Preferred Embodiment

To use the present invention, user unscrews the cap 36 from the container 20, and slowly removes the applicator 30 therefrom, past the hollow wiper 26, thereby removing excessive accumulation of product supply 50. User aligns the bristles 35 of the product applicator 30 in a parallel manner with respect to curly hair 72 located along user's hairline 70. Next, user directs the coated bristles 35 against the hairline 70 and combs through the scalp in a direction away from the hairline 70, whereby split fibers 37 of the bristles 35 are easily threaded through curly hair 72. Such procedure results in an even, optimal distribution of product supply 50 to required areas which is virtually undetectable by casual observation. Finally, after applying product supply 50 to required areas, user reinserts the product applicator 30 within the container 20 and tightens the cap 36, thereby preventing drying, leakage, spillage, or evaporation of stored product supply 50.

The use of the present invention allows a user to apply a gelatinous hair product to curly hair 72 in order to facilitate straightening thereof which is virtually undetectable by casual observation, in a manner which is quick, easy, and efficient.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be broadly limited only by the following Claims.

What is claimed is:

1. A hair product application package comprising:

a container, said container is of an elongated, circular configuration;

a product applicator; and a product supply, said product supply is defined as a clear, gelatinous composition having properties facilitating a greaseless, non-wet appearance being virtually undetectable by casual observation when applied to consumer's hair.

2. The hair product application package of claim 1, wherein said container is fabricated of translucent plastic material being suitable for storing said product supply.

3. The hair product application package of claim 1, wherein said container terminates in a threaded neck.

4. The hair product application package of claim 3, wherein said threaded neck of said container has an opening adapted to receive semi-flexible, plastic rod of said product applicator, said threaded neck threadedly receives corresponding interior threads formed on an inside of said cap, whereby tightening of said cap produces an air-tight sealable connection with said container, thereby preventing drying, leakage, spillage, or evaporation of said product supply within said container.

5. The hair product application package of claim 1, wherein said container has a hollow, tubular wiper integrally molded below said threaded neck of said container.

6. The hair product application package of claim 5, wherein said hollow, tubular wiper is designed as having a diameter measuring substantially equal to a diameter of said bristles, wherein said diameter of said bristles being measured as a distance produced by a circumference provided by said bristles as said bristles extend radially along a length of said axle.

7. The hair product application package of claim 1, wherein said product applicator comprises:

a cap, said cap is defined as having an ergonomic design with a plurality of finger-gripping channels, thereby allowing user to easily manipulate and control said product applicator during use, and wherein said cap is fabricated of a plastic material;

a semi-flexible, plastic rod, said semi-flexible, plastic rod extends longitudinally from said cap;

an axle, said axle is fixedly secured to said semi-flexible, plastic rod via epoxy, said axle extends longitudinally from said rod, said axle is fabricated of a plastic material, and wherein said axle has a length measuring between approximately 15 mm to 25 mm; and bristles, said bristles are securably embedded circumferentially along a length of said axle and extend radially from said axle.

8. The hair product application package of claim 7, wherein said finger-gripping channels of said cap define a thumb receiving channel formed along an external circumferential surface of said cap, wherein said thumb receiving channel lies opposite an index finger receiving channel and a middle finger receiving channel, said index finger receiving channel and a middle finger receiving channel are formed along an external circumferential surface of said cap, said index finger receiving channel is positioned adjacent to said middle finger receiving channel.

9. The hair product application package of claim 7, wherein said bristles are defined as split fibers fabricated from a combination of natural materials and synthetic materials, wherein said natural materials include predominantly boar's hair, and wherein said synthetic materials include polytetrafluoroethylene, nylon, and polyester.

10. The hair product application package of claim 7, wherein said axle has a fiber density of approximately 75 said split fibers per 7 mm said axle length, and wherein an individual fiber of each said split fiber has a length measuring approximately 2 mm to 4 mm.

11. The hair product application package of claim 1, wherein said container has a hollow, tubular wiper integrally molded below said threaded neck of said container, said hollow, tubular wiper serves to remove excess said product supply from said bristles of said product applicator.

12. The hair product application package of claim 1, wherein said product supply is comprised of the following ingredients: glycerol monooleate, sodium stearate, glycerin, purified $H_2O$, antibacterial agents, triundecanoin, isocetyl alcohol, and preservatives.

13. The hair product application package of claim 12, wherein said ingredients include:

80 percent to 90 percent glycerol monooleate composition by weight;

0.1 percent to 9 percent sodium stearate composition by weight;

0.1 percent to 5 percent glycerin composition by weight;

1 percent to 5 percent purified $H_2O$ composition by weight;

0.05 percent to 2 percent antibacterial agents composition by weight;

0.75 percent to 5 percent triundecanoin composition by weight;

0.65 percent to 0.75 percent isocetyl alcohol composition by weight; and 0.1 percent preservatives composition by weight.

14. The hair product application package of claim 12, wherein said preservatives include potassium sorbate and sodium benzoate.

15. The hair product application package of claim 12, wherein said antibacterial agents include senegal extract, witch hazel, and chickweed extract.

16. The hair product application package of claim 1, wherein said product supply is comprised of the following ingredients: glycerol monooleate, propylene glycol, sodium stearate, glycerin, purified $H_2O$, antibacterial agents, triundecanoin, isocetyl alcohol, fragrance, and preservatives.

17. The hair product application package of claim 16, wherein said ingredients include:

75 percent to 89 percent glycerol monooleate composition by weight;

0.75 percent to 5 percent propylene glycol composition by weight;

0.1 percent to 9 percent sodium stearate composition by weight;

0.1 percent to 5 percent glycerin composition by weight;

1 percent to 5 percent purified $H_2O$ composition by weight;

0.05 percent to 2 percent antibacterial agents composition by weight;

0.75 percent to 5 percent triundecanoin composition by weight;

0.65 percent to 0.75 percent isocetyl alcohol composition by weight; and 0.9 percent to 2 percent fragrance composition by weight; and 0.1 percent preservatives composition by weight.

18. The hair product application package of claim 1, wherein said product supply is comprised of the following ingredients: glycerol monooleate, propylene glycol, sodium stearate, glycerin; purified $H_2O$, antibacterial agents, triundecanoin, isocetyl alcohol, and preservatives.

19. The hair product application package of claim 18, wherein said ingredients include:

75 percent to 89 percent glycerol monooleate composition by weight;

0.75 percent to 5 percent propylene glycol composition by weight;

0.1 percent to 9 percent sodium stearate composition by weight;

0.1 percent to 5 percent glycerin composition by weight;

5.1 percent to 5 percent purified $H_2O$ composition by weight;

0.05 percent to 2 percent antibacterial agents composition by weight;

0.75 percent to 5 percent triundecanoin composition by weight;

0.65 percent to 0.75 percent isocetyl alcohol composition by weight; and 0.1 percent preservatives composition by weight.

* * * * *